US007317883B2

(12) United States Patent
Watanabe et al.

(10) Patent No.: US 7,317,883 B2
(45) Date of Patent: Jan. 8, 2008

(54) COLOR IMAGE FORMING APPARATUS WITH AT LEAST TWO STAGES OF IMAGE FORMING UNITS

(75) Inventors: Takeshi Watanabe, Yokohama (JP); Masashi Takahashi, Yokohama (JP); Mitsuaki Kouyama, Higashikurume (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 241 days.

(21) Appl. No.: 11/166,221

(22) Filed: Jun. 27, 2005

(65) Prior Publication Data

US 2006/0291903 A1 Dec. 28, 2006

(51) Int. Cl.
*G03G 15/02* (2006.01)
*G03G 15/24* (2006.01)

(52) U.S. Cl. ..... 399/100; 399/148; 399/149

(58) Field of Classification Search ..... 399/100, 399/148–150, 298, 299
See application file for complete search history.

(56) References Cited

U.S. PATENT DOCUMENTS

| | | | | |
|---|---|---|---|---|
| 5,286,918 | A | 2/1994 | Iwata et al. | |
| 5,797,070 | A * | 8/1998 | Waki et al. | 399/149 |
| 5,864,736 | A * | 1/1999 | Shimada et al. | 399/149 |
| 6,029,033 | A * | 2/2000 | Kawasaki | 399/149 |
| 6,332,063 | B1 * | 12/2001 | Ozawa et al. | 399/149 |
| 6,681,092 | B2 | 1/2004 | Terai | |
| 6,865,360 | B2 | 3/2005 | Takahashi et al. | |
| 6,904,251 | B2 | 6/2005 | Uyama et al. | |
| 6,920,300 | B2 * | 7/2005 | Watanabe et al. | 399/149 |
| 2001/0048827 | A1 | 12/2001 | Okada | |
| 2003/0123909 | A1 | 7/2003 | Akashi et al. | |
| 2003/0147661 | A1 | 8/2003 | Ogata | |
| 2005/0069355 | A1 | 3/2005 | Watanabe et al. | |

FOREIGN PATENT DOCUMENTS

| | | | |
|---|---|---|---|
| JP | 04-020986 | A | 1/1992 |
| JP | 2000-242152 | A | 9/2000 |
| JP | 2001-083757 | A | 3/2001 |
| JP | 2001-249511 | A | 9/2001 |
| JP | 2004-093849 | A | 3/2004 |

OTHER PUBLICATIONS

U.S. Appl. No. 11/091,600, filed Mar. 29, 2005, Watanabe et al.
U.S. Appl. No. 10/945,440, filed Sep. 21, 2004, Shimmura et al.
U.S. Appl. No. 11/081,962, filed Mar. 17, 2005, Yoshida et al.

(Continued)

*Primary Examiner*—William J. Royer
(74) *Attorney, Agent, or Firm*—Foley & Lardner LLP

(57) ABSTRACT

A color image forming apparatus in which a developing portion is provided with a mechanism capable of forming a developing agent image and recovering residual developing agent left remained on an image carrier, and an electrification portion of an image-forming unit disposed at a second stage further provided with a developing agent-removing member which is in contact with an electrifying member, thereby enabling a developing agent which is reversely transferred from a transferred image of a preceding stage and recovered by the electrification portion to be removed from the electrification portion.

14 Claims, 5 Drawing Sheets

OTHER PUBLICATIONS

U.S. Appl. No. 11/082,243, filed Mar. 17, 2005, Watanabe et al.
Office Action, Nov. 8, 2005, US. Appl. No. 10/945,440.
S. Shimmura, U.S. PTO Office Action, U.S. Appl. No. 10/945,440, filed Feb. 27, 2007, 6 pages.
S. Shimmura, U.S. PTO Office Action, U.S. Appl. No 11/647,246, filed May 31, 2007, 10 pages.
S. Shimmura, U.S. PTO Office Action, Serial No. 10/945,440, Aug. 14, 2007, 8 pages.

* cited by examiner

COLOR IMAGE FORMING APPARATUS WITH AT LEAST TWO STAGES OF IMAGE FORMING UNITS

BACKGROUND OF THE INVENTION

This invention relates to an image forming apparatus for developing an electrostatic image or a magnetic latent image in an electrophotographic method, an electrostatic printing method, or a magnetic recording method. In particular, this invention relates to a tandem type color image forming apparatus which is provided with a plurality of image-forming units.

Due to increasing trends to enhance the quality of image, to micronize the particle size of toner to employ, and to enhance the sphericity of toner in the tandem type color image forming apparatus, it is now becoming increasingly difficult to perform the cleaning of photoreceptor by means of blade. In order to miniaturize the tandem type color image forming apparatus where image-forming stations are juxtaposed horizontally with each other in particular, the distance between these stations is required to be shortened as much as possible since the number of image forming apparatus would be four for instance.

Under the circumstances, a cleaner-less process where a cleaner such as the aforementioned blade can be dispensed with is attracting many attentions in recent years.

The tandem type color image forming apparatus is accompanied with a problem of "reverse transcription", i.e. a phenomenon wherein an image that has been transferred to paper or an intermediate transfer body is caused to partially adhere onto a photoreceptor of later stage when the image happens to correspond with a non-image portion in the transfer region of a station of later stage. Since no cleaning means is provided before the transferred image is moved to the developing device in the cleaner-less process in particular, this reversely transferred toner is recovered in a developing device of later stage and mixed with a developing agent to be employed in a process of later stage, thereby generating a phenomenon of so-called color mixing wherein the color tone of image is caused to gradually change. Although the degree of color mixing is caused to fluctuate depending on the kind of image to be printed as well as on the kind of pattern, this color mixing is a fundamental problem inherent to the cleaner-less process of the tandem type color image forming apparatus.

In order to cope with this reverse transcription, there has been proposed a method, as shown in JP Laid-open Patent Publication (Kokai) No. 2000-242152 for example, wherein a roller member for removing the developing agent which has been reversely electrified, e.g. a brush roller, is contacted with a photoreceptor after finishing the transfer of image and applied with a bias voltage of the same polarity as the electrification polarity of the normal toner, thereby selectively recovering only the toner that has been electrified with reversed polarity. Although it is possible, according to this method, to prevent the color mixing resulting from the reverse transcription in the cleaner-less process, since it is required to mount a brush roller at the same position where the conventional blade cleaner is to be mounted, the resultant structure would become complicated, thus raising the problems that it is impossible to miniaturize the image forming apparatus and to reduce the manufacturing cost of the image forming apparatus.

Further, there is also proposed a method as disclosed in JP Laid-open Patent Publication (Kokai) No. 2004-93849 wherein a temporary retaining member such as a brush roller is employed and the switching of bias voltage to this temporary retaining member is performed in such a manner that during the printing operation of image, only the reversely electrified developing agent is recovered and retained in the temporary retaining member and during the non-printing operation, the developing agent recovered in the temporary retaining member is released to the photoreceptor.

It may be possible, through the application of this method to the tandem cleaner-less system, to recover the reversely transferred toner. However, since the reversely transferred toner is put back to the photoreceptor and ultimately recovered in the developing device, there is still a problem that it is impossible to avoid the color mixing.

Further, there is also proposed a method as disclosed in JP Laid-open Patent Publication (Kokai) No. 4-20986 (1992) wherein an electrification/disturbance member is employed to disturb the memory retained in the residual toner which is left untransferred concurrent with the electrification of toner for the next step in the cleaner-less process. However, since the reversely transferred toner is also recovered in the developing device together with the residual toner, it is impossible to avoid the color mixing.

BRIEF SUMMARY OF THE INVENTION

The present invention has been made under the aforementioned circumstances and therefore an object of the present invention is to prevent the generation of color mixing in the formation of color images.

According to the present invention, there is provided an image forming apparatus which comprises two or more stages of image-forming units, each image-forming unit comprising: an electrification portion provided with an electrifying member disposed to face an image carrier and designed to electrostatically charge the image carrier with a uniform surface potential to remove memories retained in residual developing agent left remained on the image carrier; an exposure portion which irradiates the electrified image carrier with light in conformity with image information to form an electrostatic latent image on the image carrier; a developing portion which feeds electrified developing agent to the electrostatic latent image to develop the latent image carrier to form a developing agent image; and a transferring portion which transfers the developing agent image to a transferring medium to form a transferred image;

wherein the developing portion is provided with a mechanism which is capable of forming the developing agent image and recovering residual developing agent left remained on the image carrier; and the electrification portion of at least the image-forming unit or the image-forming units which are disposed at the second state and thereafter are further provided with a developing agent-removing member which is designed to contact with the electrifying member, thereby enabling the developing agent which is reversely transferred from the transferred image of the preceding stage and recovered by the electrification portion to be removed from the electrification portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
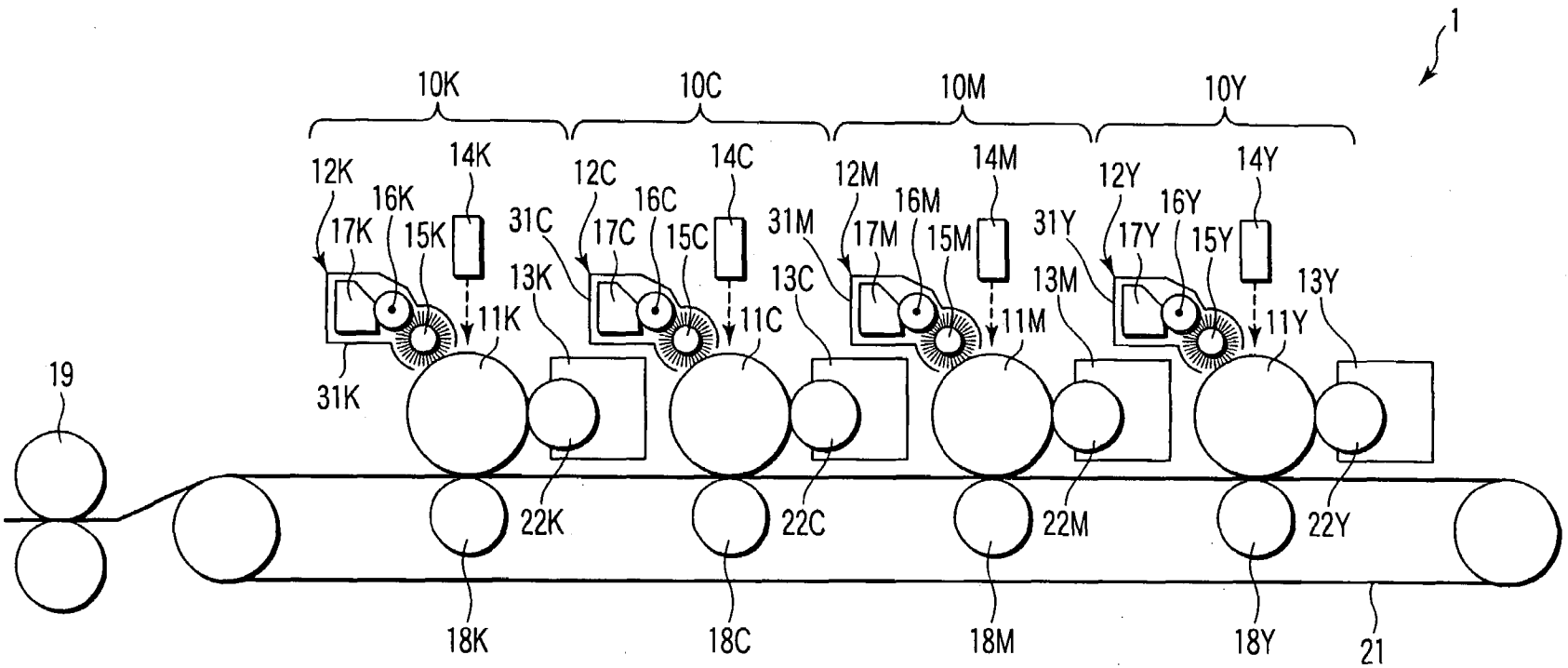
FIG. 1 is a diagram schematically illustrating one embodiment of the image forming apparatus according to the present invention.

The color image forming apparatus according to the present invention is constituted by a first image-forming unit comprising: a first electrification portion provided with an electrifying member disposed to face an image carrier and designed to electrostatically charge the image carrier with a uniform surface potential and to remove memories retained in residual developing agent left remained on the image carrier; a first exposure portion which irradiates the electrified image carrier with light in conformity with first color image information to form an electrostatic latent image on the image carrier; a first developing portion which feeds an electrified first color developing agent to the electrostatic latent image to develop the latent image to form a first developing agent image; and a first transferring portion which transfers the first developing agent image to a transferring medium to form a transferred image; and by a second image-forming unit comprising: a second electrification portion disposed to face an image carrier; a second exposure portion for irradiating the electrified image carrier with light in conformity with second color image information to form an electrostatic latent image on the image carrier; a second developing portion for feeding an electrified second color developing agent to the electrostatic latent image to develop the latent image to thereby form a second developing agent image; and a second transferring portion for transferring the second developing agent image to a transferring medium having the first developing agent image formed thereon to form a transferred image;

wherein the electrification portion of the second image-forming unit is further provided with a second developing agent-removing member which is designed to contact with the electrifying member, thereby enabling the first developing agent which is reversibly transferred from the first transferred image and recovered by the electrification portion to be removed from the second electrification portion.

If required, it is possible to further incorporate a third and a fourth image forming units having the same structure as that of the aforementioned second image forming unit into the image forming device.

The electrification portion to be employed in the present invention is not only capable of electrostatically charging the image carrier with a uniform surface potential but also capable of librating flocculated residual developing agent left untransferred from the image carrier, thereby removing the memory of pattern retained in residual developing agent left remained on the image carrier. Additionally, the electrification portion is capable of removing the reversely transferred developing agent that has been adhered, through reverse transcription, to the image carrier from the transferred image of preceding stage.

This reverse transcription would be caused to generate due to undesirable electric discharge at the second transferring portion and would become more prominent as the transferring electric field becomes stronger. The polarity of the first developing agent adhered onto the image carrier due to this reverse transcription is opposite to the polarity of the second developing agent. Further, even undesirable paper dust left remained on the image carrier together with the reversely transferred developing agent can also be adhered onto this electrification member and recovered from the image carrier.

Since it is infeasible that a recording material having a transferred image is delivered to the first image-forming unit in the ordinary usage of the image forming apparatus, there is no possibility of generating the reverse transcription. Therefore, it is not necessary to recover the reversely transferred developing agent by means of the first electrifying member. Whereas in the cases of the second image forming unit and the subsequent image forming units following the second image forming unit, this reversely transferred developing agent is permitted to adhere onto the electrifying member. Therefore, it is possible, through the provision of a member which is capable of removing this reversely transferred developing agent from the electrifying member, to recover this reversely transferred developing agent without returning it to the image carrier. By the way, even in the first image forming unit, it is possible to further install a member which is capable of removing this reversely transferred developing agent from the electrifying member.

As described above, according to the present invention, the residual developing agent left remained on the image carrier after the transferring step and the reversely transferred developing agent can be individually removed from the image carrier, i.e. while the reversely transferred developing agent is removed at the electrification portion, the residual developing agent is removed at the developing portion without being removed at the electrification portion. As a result, the reversely transferred developing agent can be substantially prevented from entering into the developing portion. Therefore, according to the present invention, it is possible to prevent the color mixing of the residual developing agent and the reversely transferred developing agent and hence to create an excellent image which is free from any change in color hue.

The electrification portion of the image forming unit may further comprise a developing agent storage for accommodating the developing agent that has been removed. Since the quantity of developing agent to be removed at this electrification portion is smaller than a total of the residual developing agent and the reversely transferred developing agent, the capacity of this developing agent storage may not be so large, so that the provision of this developing agent storage would not necessitate the creation of a large scale apparatus.

Further, it is possible, according to the present invention, to make the electrifying member, the developing agent removing member and this optional developing agent storage integral with each other, it is possible to save the space as compared with the case where a cleaning portion is installed separately from the electrification portion. As a result, the intervals between the image-forming units in a tandem type image forming apparatus can be shortened, thus making it possible to miniaturize the entire structure of the image forming apparatus and to reduce the constructing cost thereof.

FIG. 1 shows a diagram schematically illustrating one embodiment of the image forming apparatus according to the present invention.

As shown in FIG. 1, this color image forming apparatus 1 is of tandem type structure wherein a first, a second, a third and a fourth image-forming units 10Y, 10M, 10C and 10K are arrayed on a belt-like delivery member 21 in the mentioned order, and a fixing portion 19 is installed at a stage following the fourth image-forming unit 10K. By the way, symbols Y, M, C and K represent members to be employed in the formation of a yellow, a magenta, a cyan, and a black image, respectively. In the drawings, the same members are represented by the same reference symbols.

The first image-forming unit 10Y comprises: a first photoreceptor 11Y, a first electrification portion 12Y disposed to face the first photoreceptor 11Y so as to electrostatically charge the first photoreceptor 11Y with a uniform surface potential; a first exposure portion 14Y for irradiating the electrified first photoreceptor 11Y with light in conformity with an image information to form a first electrostatic latent image on the first photoreceptor 11Y; a first developing portion 13Y having not only a mechanism for feeding an electrified first developing agent, e.g. yellow (Y) developing agent, to the first electrostatic latent image to develop the first electrostatic latent image to thereby form a first developing agent image, e.g. a yellow developing agent image but also a mechanism for recovering the yellow developing agent left remained on the first photoreceptor 11Y; and a first transferring portion 18Y for transferring the yellow developing agent image developed at the first developing portion 13Y to a transferring medium.

The first electrification portion 12Y is removably housed in a case 31Y, thus constructing an integral body, and comprises a first electrifying member 15Y of brush-like configuration for instance; a first developing agent-removing member 16Y of roller-like configuration for instance which is contacted with the first electrifying member 15Y so as to remove the reversely transferred developing agent and paper dust which are adhered onto the first electrifying member 15Y; and a first developing agent storage 17Y provided with a cleaning blade for scraping away the reversely transferred developing agent and paper dust which are removed by the first developing agent-removing member 16Y.

The first electrifying member 15Y is disposed in contact with the first photoreceptor 11Y and is configured into a brush roller-like body by making use of a fiber brush-like material for instance. This material is made, for example, of nylon fiber having a thickness of 0.5-6 denier. This roller has a diameter of 10-20 mm and an electric resistance of $10e^4$-$10e^{10}\Omega$ and is enabled to rotate at a different velocity from that of the first photoreceptor 11Y. For example, the first electrifying member 15Y may be formed of a brush roller made of 2 denier fiber and having a diameter of 16 mm and is enabled to rotate with at a rotational speed which is twice as high as that of the first photoreceptor 11Y. This brush roller is impressed with a bias voltage, for example DC-1000v, for electrifying the first photoreceptor 11Y. As a result, the first photoreceptor 11Y is electrified at a voltage of −500V and, at the same time, the aggregation of residual developing agent retaining the pattern of developing agent image and electrified with negative polarity for example can be dispersed and liberated by scrubbing using this brush roller. As a result, it is now possible to prevent the residual developing agent from becoming an obstacle in the exposure on the occasion of the next image forming step, or from becoming a flaw of image due to failure to recover the residual developing agent on the occasion of performing simultaneous development and cleaning as the quantity of residual developing agent is excessively left remained locally.

At the same time, the reversely electrified developing agent that has been reversely transferred mainly from the preceding station is enabled to adhere onto the brush roller. The brush roller is contacted with a metal roller employed as the first developing agent-removing member 16Y and this metal roller is impressed in advance with a bias voltage which makes it possible to move the developing agent having the positive polarity and adhered to the brush roller to the metal roller. For example, when the metal roller is impressed with a bias voltage of −1200V, the positively electrified developing agent that has been adhered to the brush roller is enabled to move to the metal roller. Additionally, since the metal roller is equipped with a cleaning blade, the positively electrified developing agent that has been adhered to the metal roller can be removed therefrom.

Since the positively electrified developing agent is mainly constituted by the reversely transferred developing agent, the quantity thereof would be relatively small. Therefore, it is not required to provide a waste toner tank of large capacity as the first developing agent storage 17Y for accommodating the developing agent that has been removed. Although it depends on the composition of developing agent and the transferring conditions, the quantity of the reversely transferred developing agent, when measured about the developing agent existing on the photoreceptor, was 1-5 $\mu g/cm^2$ for a polymer toner and 4-10 $\mu g/cm^2$ for even an ordinary pulverized toner. Assuming that a pulverized toner is employed, that C, M and Y are printed at 7% respectively under the condition of 10 $\mu g/cm^2$ for instance, and that all of these toners are reversely transferred at the K station, the quantity of reversely transferred developing agent to be recovered would be only 65 g or so even if the printing was repeated 50000 times.

As long as the quantity of reversely transferred developing agent to be recovered can be confined to this degree, it would not be necessary to separately install a waste toner tank. Namely, it would be possible to sufficiently cope with the problem by simply providing a region for accommodating the waste toner in the vicinity of the cleaning blade. For example, if it is constructed such that the photoreceptor and the electrification portion are formed into a cartridge and that the cartridge is entirely renewed every time after a repetition of 50000 times of printing, the image forming apparatus would be used by users as if the generation of waste toner is prevented in the apparatus.

If the life of the photoreceptor is much longer than that of the electrification portion, the electrification portion, the developing agent removing member and a member for accommodating the waste toner may be integrally constructed with each other so that they can be renewed en bloc. For example, as shown in FIG. 1, the first electrification portion 12Y comprising the first electrifying member 15Y, the first developing agent-removing member 16Y, the first developing agent storage 17Y provided with a cleaning blade may be housed in a removable case 31Y, thereby providing them as an integral body. Further, although not shown in FIG. 1, the first electrification portion 12Y and the first photoreceptor 11Y may be integrally constructed to make them renewable en bloc.

Further, the capacity of the region for accommodating the reversely electrified developing agent may be varied in such a manner that the fourth image-forming unit has a largest capacity and the image-forming units preceding the fourth image-forming unit have a smaller capacity than that of the fourth image-forming unit. In the case of a four-sequence tandem structure, since there is no possibility, in general, that the reversely transferred toner is permitted to exist in the first image-forming unit 10Y the first developing agent-removing member 16Y as well as the first developing agent storage 17Y can be omitted from the electrification portion thereof. In the second image-forming unit 10M, it is only required to take into consideration only the reversely transferred toner from the first image-forming unit 10Y. For example, as calculated based on the aforementioned example, the quantity of the reversely transferred toner would become 65×7/21=22 g in the second image-forming unit 10M. Likewise, the quantity of the reversely transferred toner would become 65×14/21=43 g in the third image-forming unit 10C. Namely, by making the capacity of the region for accommodating the reversely electrified developing agent smaller in the preceding image-forming unit as compared with that of the following image-forming unit, it is possible to miniaturize the entire structure of the image-forming apparatus 1.

Further, the aforementioned metal roller may be formed of a stainless steel roller having a diameter of 12 mm and enabled to rotate at a rotational speed which is ½ of that of the brush roller. It is also possible to recover the reversely transferred developing agent without being confined to the aforementioned conditions. Further, although an urethane blade was proposed to employ as a cleaning blade, it is also possible to employ a more convenient material such as Myler.

According to the apparatus shown in FIG. 1, it is possible to recover the reversely transferred developing agent and the residual developing agent by making use of a smaller space than that of the conventional apparatus, thereby making it possible to miniaturize the apparatus. Further, the region for accommodating the reversely transferred toner may be positioned at the region where the cleaning device is to be installed.

In the developing portion 13Y, a two-component developing agent comprising a mixture of a non-magnetic toner to be electrified with negative polarity and a magnetic carrier is accommodated therein, and ears formed by means of the carriers are formed on a developing roller 22Y equipped with a magnet. Then, by applying a voltage of about −200V to −400V to the developing roller 22Y, the developing agent is permitted to adhere to the exposed portion of the surface of photoreceptor 11Y and is not permitted to adhere to the non-exposed portion thereof.

In the mechanism for recovering the developing agent in the developing portion 13Y, the residual developing agent, the polarity thereof being (−) or (+) depending on the environment or on the condition of transferring bias, is impressed with (−) charge on the occasion of electrifying the photoreceptor with minus polarity in the step of electrification, so that the residual developing agent is entirely enabled to have (−) polarity. As a result, on the occasion when the residual developing agent reaches the developing portion, the residual developing agent in the image region is permitted to develop while being adhered onto the surface of the photoreceptor, whereas the residual developing agent by the non-image region is recovered in the developing roller, thereby executing so-called simultaneous development and cleaning The second, the third and the fourth image-forming units are constructed in the same manner as that of the aforementioned first image-forming unit. Thus, the transferring medium having the first developing agent image transferred thereto at the first transferring portion is delivered to the second transferring portion to perform the transfer of the second developing agent image. Thereafter, the transferring medium having the first and second developing agent images transferred thereto is delivered to the third transferring portion to perform the transfer of the third developing agent image. Likewise, the transferring medium having the first, second and third developing agent images transferred thereto is delivered to the fourth transferring portion to perform the transfer of the fourth developing agent image, thereby obtaining a transferring medium on which the first, second, third and fourth developing agent images, i.e. four-color images consisting of Y, M, C and K, are superimposed. The conditions for the transfer at each of these transferring portions may be changed as required. The electric voltage to be applied to these transferring portions may be confined to the range of about +300 kV to 2 kV. Further, when the first developing agent-removing member and the first developing agent storage are omitted at the first electrification portion, the image forming apparatus can be further miniaturized.

In the transferring portions of the second, third and fourth stages, the developing agent image being transferred to the transferring medium delivered from the preceding transferring portion may sometimes be reversely transferred. For example, at the second transferring portion, the first developing agent, i.e. a yellow developing agent, may be reversely transferred onto the second photoreceptor 11M.

Further, an intermediate transferring body may be installed in place of the delivery member 21, thereby enabling developing agent images of four colors, i.e. Y, M, C and K, to be transferred onto this intermediate transferring body. In this case, a secondary transferring member is interposed between the fourth image-forming unit 10K and the fixing portion 19 so as to enable these developing agent images of four colors to be transferred onto a transferring medium.

At the subsequent stage of the fourth image-forming unit 10K, there is disposed a fixing portion 19 comprising, for example, a heat roller and a press roller, thereby enabling to fix the transferring medium having developing agent images of four colors, Y, M, C and K.

Further, in order to explain examples wherein the image forming apparatus of the present invention is applied, FIGS. 2 to 7 illustrate respectively one of the image-forming units to be employed in four stages.

Figure 2:
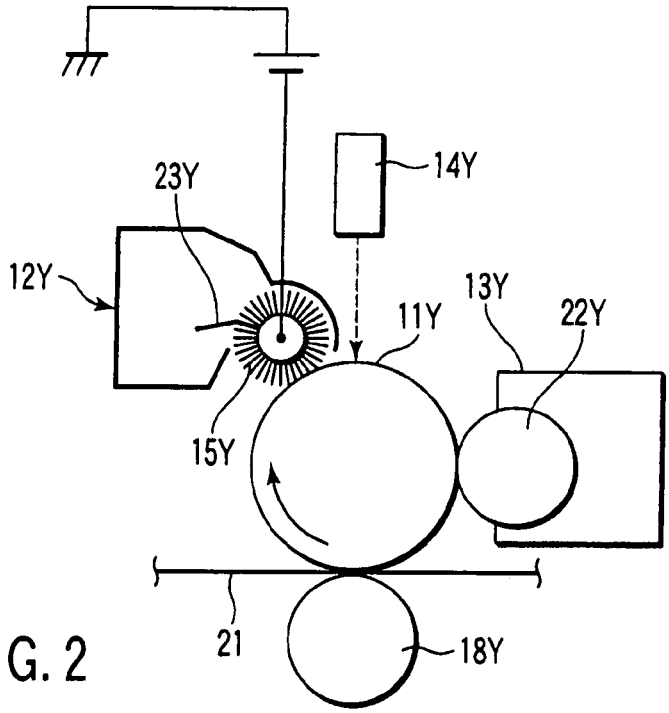
FIG. 2 shows one example of the image-forming unit to be employed in another embodiment of the image forming apparatus according to the present invention.

The image-forming unit shown in FIG. 2 is unit 10Y shown in FIG. 1 except that a duster bar 23Y is provided in place of the metal roller 16Y, thereby making it possible to beat away the reversely transferred developing agent that has been adhered onto the brush-like first electrifying member 15Y.

Figure 3:
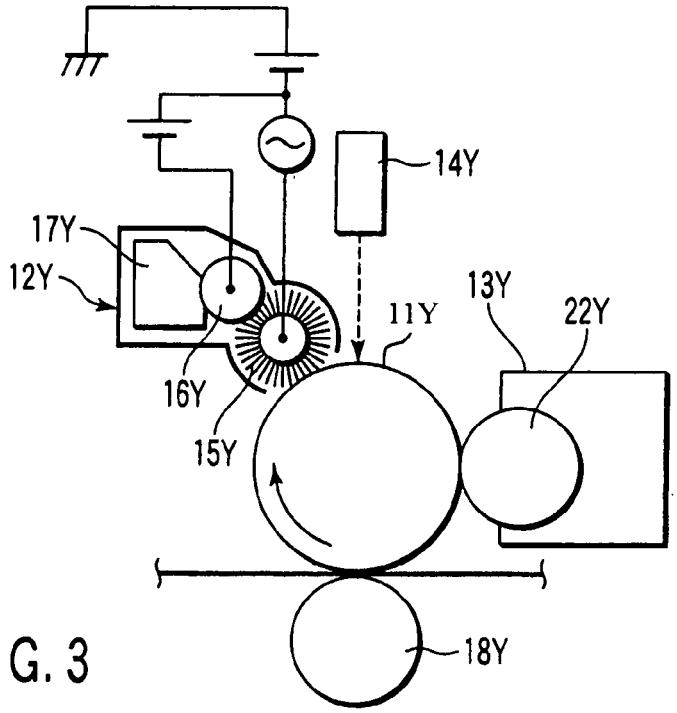
FIG. 3 shows one example of the image-forming unit to be employed in a further embodiment of the image forming apparatus according to the present invention.

This fiber brush-like first electrifying member 15Y is adapted to be impressed with a bias voltage of DC-1100V for instance. As a result, the photoreceptor 11Y can be uniformly surface-charged to about 500V, so that the residual developing agent can be dispersed by the brush and the reversely transferred developing agent can be recovered and beaten down by the duster bar 23Y The image-forming unit shown in FIG. 3 is constructed in the same manner as the image-forming unit 10Y shown in FIG. 1 except that the fiber brush-like first electrifying member 15Y is adapted to be impressed with an oscillating voltage of AC-400V in addition to DC-700V instead of being impressed with a bias voltage of DC-1100V. As a result, the photoreceptor 11Y can be uniformly surface-charged to about 500V, so that the residual developing agent can be dispersed by the brush 15Y and the reversely transferred developing agent can be recovered and scraped away by a cleaning blade after the developing agent is moved to the metal roller 16Y.

Figure 4:
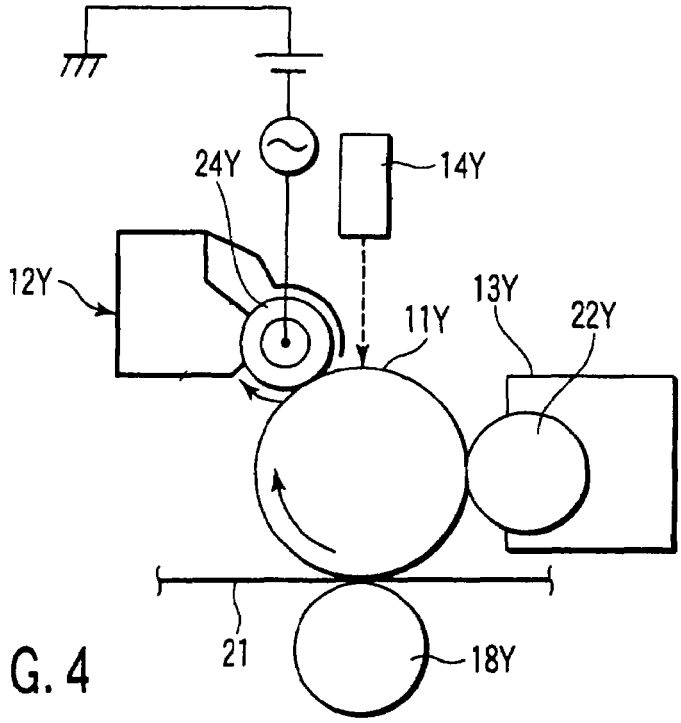
FIG. 4 shows one example of the image-forming unit to be employed in a further embodiment of the image forming apparatus according to the present invention.

The image-forming unit shown in FIG. 4 is constructed in the same manner as the image-forming unit 10Y shown in FIG. 1 except that, in place of the fiber brush-like first electrifying member 15Y, a roller-like magnetic brush electrifying member 24Y is provided and that the roller-like first developing agent-removing member 16Y is not employed.

Further, the elastic roller-like electrifying member 24Y is adapted to be impressed with an oscillating voltage of AC-1100V in addition to DC-500V. As a result, the photoreceptor 11Y can be uniformly surface-charged to about 500V, so that the residual developing agent can be dispersed by the elastic roller-like electrifying member 24Y and the reversely transferred developing agent can be recovered and scraped away by a cleaning blade.

Figure 5:
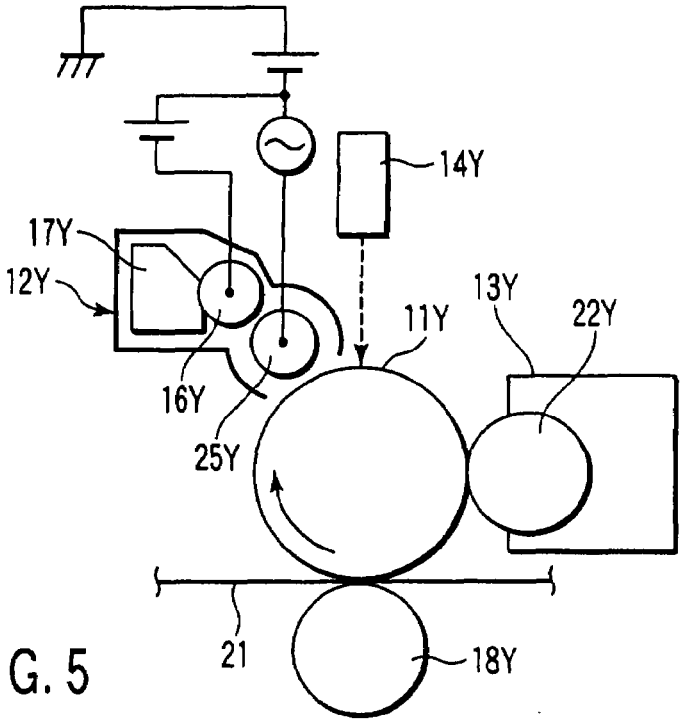
FIG. 5 shows one example of the image-forming unit to be employed in a further embodiment of the image forming apparatus according to the present invention.

The image-forming unit shown in FIG. 5 is constructed in the same manner as the image-forming unit shown in FIG. 3 except that, in place of the fiber brush-like first electrifying member 15Y, a roller-like magnetic brush electrifying member 25Y is provided and that the metal roller 16Y is spaced away from this roller-like magnetic brush electrifying member 25Y. This magnetic brush electrifying member 25Y is adapted to be impressed, at the magnet-built-in roller thereof, with an oscillating bias voltage of AC 1100V in addition to DC-500V. Carrier particles having a particle diameter ranging from 5 to 60 pm are permitted to exist around the circumferential surface of the magnet-built-in roller, so that when the photoreceptor 11Y is contacted with these carrier particles, the photoreceptor 11Y will be uniformly surface-charged to about 500V, so that the residual developing agent can be dispersed and the reversely transferred developing agent can be recovered by the carrier particles and scraped away by a cleaning blade.

Figure 6:
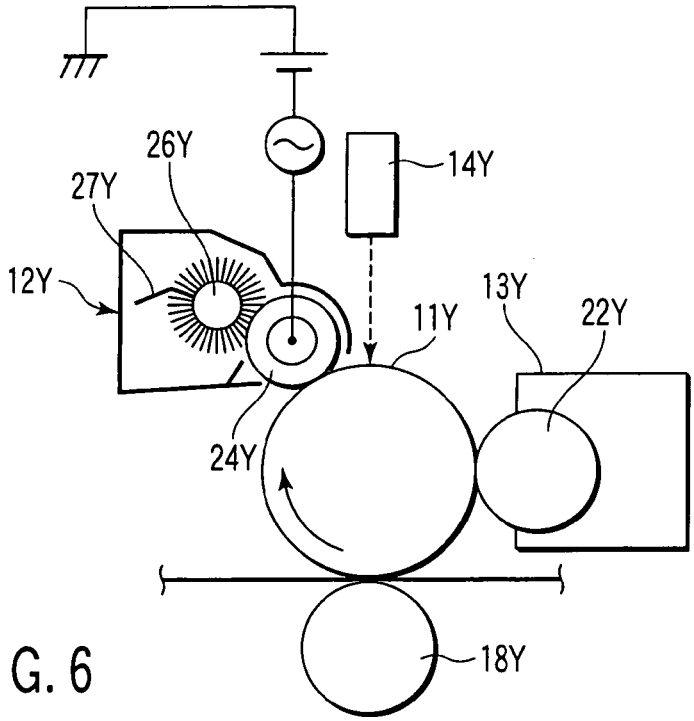
FIG. 6 shows one example of the image-forming unit to be employed in a further embodiment of the image forming apparatus according to the present invention.

The image-forming unit shown in FIG. 6 is constructed in the same manner as the image-forming unit shown in FIG. 4 except that a brush roller 26Y to be rotated in the direction opposite to that of the elastic roller-like electrifying member 24Y at a peripheral speed twice as high as that of the electrifying member 24Y is provided in contact with the electrifying member 24Y and that a duster bar 27Y is provided.

The elastic roller-like electrifying member 24Y is adapted to be impressed with an oscillating voltage of AC-1100V in addition to DC-500V. As a result, the photoreceptor 11Y can be uniformly surface-charged to about 500V, so that the residual developing agent can be dispersed by the elastic roller-like electrifying member 24Y and the reversely transferred developing agent can be recovered and scraped away by the brush roller 26Y and then beaten down by the duster bar 27Y.

Figure 7:
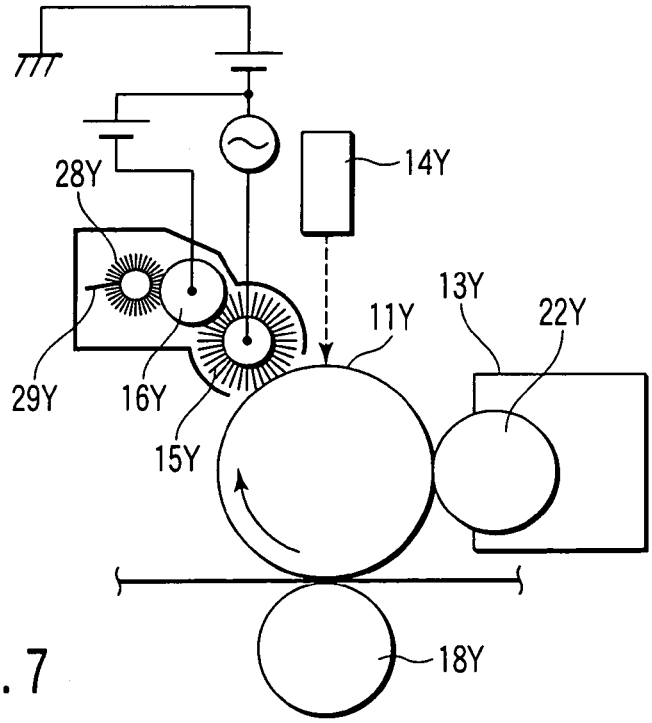
FIG. 7 shows one example of the image-forming unit to be employed in a further embodiment of the image forming apparatus according to the present invention.

The image-forming unit shown in FIG. 7 is constructed in the same manner as the image-forming unit shown in FIG. 3 except that, in place of the first developing agent storage 17Y provided with a cleaning blade, a brush roller 28Y and a duster bar 29Y disposed in contact with the brush roller 15Y and designed to be rotated in the direction opposite to that of the brush roller 15Y at a peripheral speed twice as high as that of the brush roller 28Y are provided. The fiber brush-like first electrifying member 15Y is adapted to be impressed with an oscillating voltage of AC-400V in addition to DC-700V. As a result, the photoreceptor 11Y can be uniformly surface-charged to about 500V, so that the residual developing agent can be dispersed by the brush roller 28Y and the reversely transferred developing agent can be recovered and, after being moved to a metal roller 16Y, scraped away by the brush roller 28Y and then beaten down by the duster bar 29Y.

By making use of the apparatus shown in FIG. 1, investigations were made on the relationships between the transferring bias at the transferring portion to be employed in the image-forming unit 10M of the second stage and the transferring properties, i.e. the quantity of residual developing agent and the quantity of reversely transferred developing agent.

Figure 8:
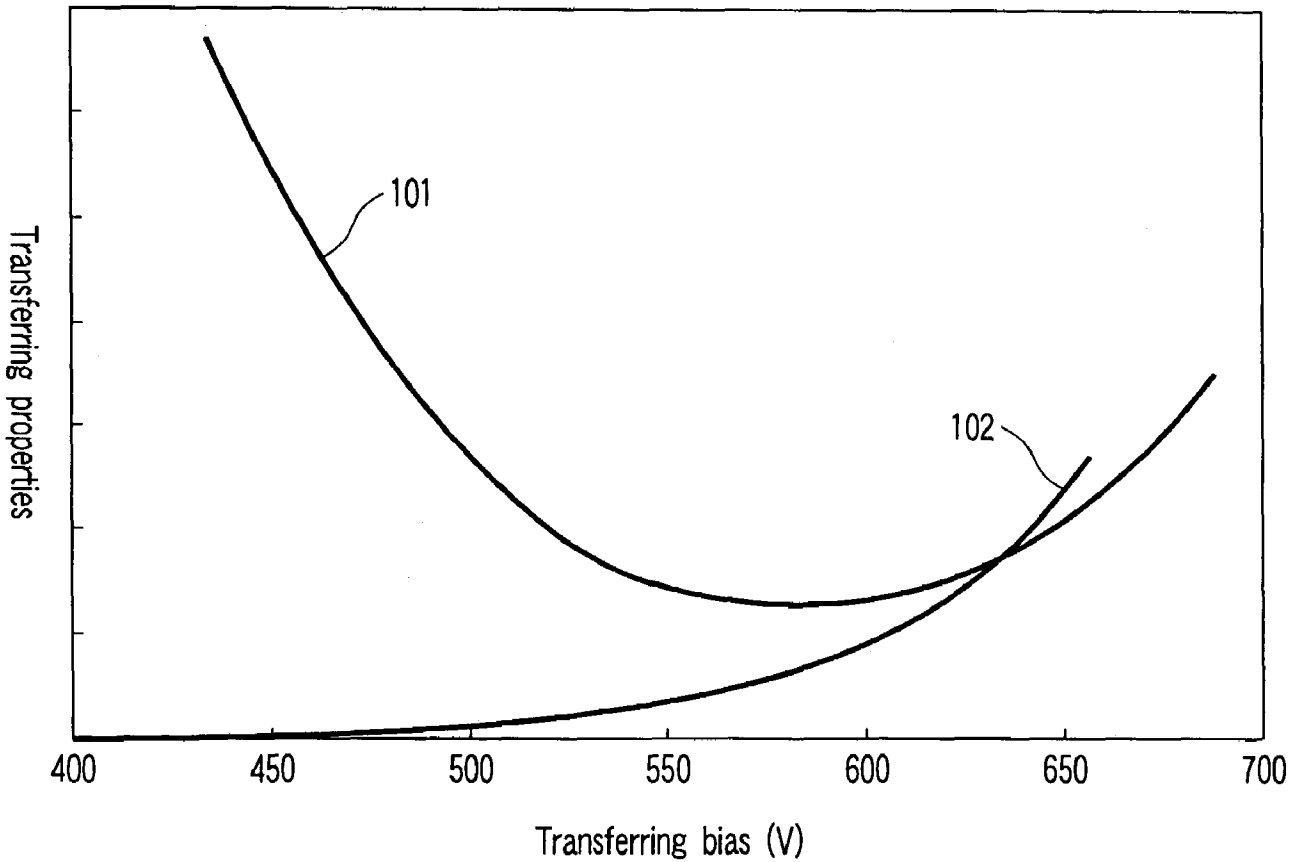
FIG. 8 is a graph illustrating the relationship between the transferring bias at the transferring portion of the second stage and the quantity of residual developing agent as well as the relationship between the transferring bias at the transferring portion of the second stage and the quantity of reversely transferred developing agent.

FIG. 8 is a graph illustrating the aforementioned relationships.

As shown in FIG. 8, although it was possible to decrease the quantity of residual developing agent by increasing the magnitude of transferring bias, the quantity of residual developing agent became the lowest at about 550V to 600V and when the transferring bias was increased higher than this range, the quantity of residual developing agent was again increased. Further, it was found out that when the transferring bias was increased, the quantity of reversely transferred developing agent became more liable to increase.

Further, the quantity of electrified residual developing agent and the quantity of electrified reversely transferred developing agent were −6.0 μC/g and +2.5 μC/g, respectively when the transferring bias was 550V, −5.2 μC/g and +4.0 μC/g, respectively when the transferring bias was 600V, and −3.0 μC/g and +7.0 μC/g, respectively when the transferring bias was 650V.

In the case of this apparatus, it will be employed at a transferring bias of about 550V to 600V.

EXAMPLE

Next, the present invention will be more specifically explained with reference to examples.

Example 1

The apparatus shown in FIG. 1 was prepared.

Further, four kinds of two-component developing agents each having one of the following color compositions and manufactured by means of polymerization method for example were applied to this apparatus.

The compositions of developing agents employed herein.

| | |
|---|---|
| Yellow developing agent: | |
| Binder resin: Styrene-acrylic resin | 77 parts by weight |
| Colorant: C.I. Pigment Yellow | 7 parts by weight |
| Paraffin wax, etc. | |
| Magenta developing agent: | |
| Binder resin: Styrene-acrylic resin | 77 parts by weight |
| Colorant: C.I. Pigment Red | 7 parts by weight |
| Paraffin wax, etc. | |
| Cyan developing agent: | |
| Binder resin: Styrene-acrylic resin | 77 parts by weight |
| Colorant: C.I. Pigment Blue | 7 parts by weight |
| Paraffin wax, etc. | |
| Black developing agent: | |
| Binder resin: Styrene-acrylic resin | 77 parts by weight |
| Colorant: Carbon black | 7 parts by weight |

Mixing ratio thereof with carrier: 7.5 wt % based on a total weight of the developing agent.

Test 1:

As a test sample, a pattern of the initial cyan image was printed on an A4 size paper at a printing area ratio of 7% in the third cyan image-forming unit 10C.

Then, in the first yellow image-forming unit 10Y, a pattern was printed on an A4 size paper at a printing area ratio of 7%. In the second magenta image-forming unit 10M, a pattern having a printing area ratio of 7% was printed so as not to overlap with the yellow image. In the third cyan image-forming unit 10C and the fourth black image-forming unit 10K, the printing was not performed. A continuous printing as described above was repeated 50000 times.

Subsequently, when the chromaticity of the initial cyan image was compared with the chromaticity of the cyan image obtained after a continuous printing of 50000 times, a color difference ΔE was: ΔE=5.0. Since acceptable fluctuation in color difference is generally considered as being about 6-7, the result obtained above was found acceptable.

In this case, when a half-tone cyan image (a vertical stripe pattern of 3-dot modulation of 600 dpi) about 0.4 in reflection concentration of image was printed to visually assess the quality of image, a slight degree of linear non-uniformity due to the repetition of 50000 times of brushing was recognized.

Further, the quantity of reversely electrified developing agent that was recovered in the developing agent storage at the electrification portion of the third cyan image-forming unit 10C was 25.0 g.

Further, after finishing 50000 times of repetition of the continuous printing of images, the apparatus employed in the experiment was entirely left standing for 8 hours in an environment of: 30° C. in temperature and 80% in humidity. Thereafter, a white image was printed to visually assess the generation of blushing in this printing.

Test 2:

Then, in the first yellow image-forming unit 10Y, a pattern having a printing area ratio of 7% was performed on an A4 size paper. In the second magenta image-forming unit 10M, a pattern having a printing area ratio of 7% was printed so as not to overlap with the yellow image. In the third cyan image-forming unit 10C also, a pattern having a printing area ratio of 7% was printed so as not to overlap with the yellow and magenta images. In the fourth black image-forming unit 10K, the printing was not performed. A continuous printing as described above was repeated 50000 times.

Subsequently, when the chromaticity of the initial cyan image was compared with the chromaticity of the cyan image obtained after a continuous printing of 50000 times, a color difference ΔE was: ΔE=10. Further, when a half-tone cyan image was printed in the same manner as the aforementioned Test 1, a slight degree of linear non-uniformity was recognized.

Further, the quantity of reversely electrified developing agent that was recovered in the developing agent storage at the electrification portion of the third cyan image-forming unit 10C in this case was found slightly increased as compared with that of Test 1, i.e. 30.0 g.

The specifications of the electrification portion employed herein are shown in Table 1 and the results obtained are shown in the following Tables 2 and 3.

Example 2

By making use of the apparatus provided with the image-forming unit shown in FIG. 2 in place of each of the image-forming units of the apparatus shown in FIG. 1, Test 1 and Test 2 were performed in the same manner as described above.

This apparatus was constructed such that a duster bar was employed in place of the blade and that the duster bar was contacted with the brush-like electrifying member. In the Test 1, ΔE=7.0 and the quantity of developing agent accumulated in the storage of reversely transferred toner was 15 g, which was smaller than that of Example 1.

Further, a linear non-uniformity was also recognized more or less in the half-tone image.

On the other hand, in the Test 2, the color difference was: ΔE=3.2 and the quantity of developing agent accumulated in the storage of reversely transferred toner was 25 g and a linear non-uniformity was also recognized in the half-tone image.

In this structure, since the duster bar was not impressed with a bias voltage, the reversely electrified developing agent that was recovered by the brush electrifier could not be completely beaten away, so that the developing agent was permitted to convert into normal polarity due to the electric discharge to be generated on the occasion of electrification, thus generating a phenomenon where the developing agent was permitted to return onto the photoreceptor and hence recovered in the developing portion. It was assumed that, because of this reason, the fluctuation of color difference was caused to increase as compared with Example 1.

The specifications of the electrification portion employed herein are shown in Table 1 and the results obtained are shown in the following Tables 2 and 3.

Example 3

By making use of the apparatus provided with the image-forming unit shown in FIG. 3 in place of each of the image-forming units of the apparatus shown in FIG. 1, Test 1 and Test 2 were performed in the same manner as described above.

This apparatus was constructed such that the brush was superimposed with an AC bias. In the Test 1, the non-uniformity of image due to the non-uniformity of electrification which was specific to the brush was amended. The color difference after 50000 times of repetition of printing was: ΔE=4.5, the recovery of reversely transferred toner was further improved, and the quantity of developing agent accumulated in the storage space of reversely electrified developing agent was 30 g. Even in the Test 2, the quality of image was acceptable, i.e. ΔE=2.2. However, the quantity of toner accumulated in the storage space of reversely electrified developing agent was 509, indicating a substantial increase as compared with Example 1. The reason for this may be attributed to the fact that since the electrifying member was superimposed with an AC bias, even the residual developing agent that had been electrified with normal polarity was caused to remove though the quantity thereof may be small.

The specifications of the electrification portion employed herein are shown in Table 1 and the results obtained are shown in the following Tables 2 and 3.

Example 4

By making use of the apparatus provided with the image-forming unit shown in FIG. 4 in place of each of the image-forming units of the apparatus shown in FIG. 1, Test 1 and Test 2 were performed in the same manner as described above.

This apparatus was constructed such that an elastic roller made of conductive urethane rubber and covered thereon with a fluorinated surface layer was employed as the electrifying member. In the Test 1, the color difference between the initial image and the image after 50000 times of repetition of printing was: ΔE=4.0. The quantity of developing agent accumulated in the storage space of reversely electrified developing agent was 32 g and also linear flaw was not so prominent in the half-tone image. In the Test 2, the color difference was: ΔE=2.1. Although the linear flaw in the image was not so prominent, the quantity of developing agent accumulated in the storage space of reversely electrified developing agent was as very large as 70 g. The reason for this may be attributed to the fact that since the elastic roller was impressed with an AC bias, the developing agent of normal color was caused to adhere onto the electrifying roller and all of the developing agent thus adhered was scraped away from the electrifying roller and removed therefrom, thus rendering the quantity of waste toner to become very large.

The specifications of the electrification portion employed herein are shown in Table 1 and the results obtained are shown in the following Tables 2 and 3.

Example 5

By making use of the apparatus provided with the image-forming unit shown in FIG. 5 in place of each of the image-forming units of the apparatus shown in FIG. 1, Test 1 and Test 2 were performed in the same manner as described above.

In this apparatus, a magnetic brush electrifier was employed as the electrifying member. In the Test 1, the color difference after 50000 times of repetition of printing was: ΔE=3.0, indicating very excellent level. The quantity of developing agent accumulated in the storage space of reversely electrified developing agent was very small as 15 g and the half-tone image was also free from any problems. The reason for this may be attributed to the fact that the magnetic brush electrifier itself retained a large quantity of reversely electrified developing agent. In the Test 2, the color difference was: ΔE=3.0 and the quantity of developing agent accumulated in the storage space of reversely electrified developing agent was 40 g and the half-tone image was also free from any problems. In the case of the magnetic brush electrifier, although it was possible to realize excellent performance when only the reversely transferred developing agent was dealt with without performing the printing of image at the cyan station, if the printing was performed also in the cyan station, the performance of apparatus tended to deteriorate more or less as compared with other systems. The reason for this may be attributed to the fact that since the magnetic brush was also impressed with an AC bias, the residual developing agent of normal color was enabled to be entrapped by the magnetic brush, so that when the residual developing agent thus entrapped was increased and the quantity of developing agent retained in the magnetic brush became large, the performance of the magnetic brush was caused to deteriorate more or less.

The specifications of the electrification portion employed herein are shown in Table 1 and the results obtained are shown in the following Tables 2 and 3.

Comparative Example 1

By making use of an image forming apparatus having the same structure as that shown in FIG. 1 except that a flat brush electrifier was employed and the developing agent removing member and the developing agent storage were not installed therein, Test 1 and Test 2 were performed in the same manner as described above.

In the Test 1, when a color difference between the initial cyan image before the continuous printing and the cyan image obtained after a continuous printing of 50000 times, ΔE was: ΔE=20. Since acceptable fluctuation in color difference is generally considered as being about 6-7, the result obtained above was found not acceptable. Further, when a half-tone cyan image having an image reflection concentration of about 0.4 was printed at this moment (after the repetition of 50 k) to visually assess the quality of image, a slight degree of linear non-uniformity due to the brushing was recognized.

In the Test 2 performed subsequently, ΔE was: ΔE=10. Further, when a half-tone image was printed in the same manner as described above, the linear non-uniformity became more prominent in the image.

The specifications of the electrification portion employed herein are shown in Table 1 and the results obtained are shown in the following Tables 2 and 3.

TABLE 1

| | Electrifying member | Reversely transferred developing agent-removing member |
|---|---|---|
| Ex. 1 of prior art | — | — |
| Ex. 1 | Brush roller + DC | Metal roller |
| Ex. 2 | Brush roller + DC | Duster bar |
| Ex. 3 | Brush roller + DC + AC | Metal roller |
| Ex. 4 | Elastic roller + DC + AC | Blade |
| Ex. 5 | Magnetic brush roller + DC + A | Metal roller |

TABLE 2

| | Test 1 | | | |
|---|---|---|---|---|
| | Color difference (ΔE=) of cyan between image after 50 k printing and initial image | Toner (g) accumulated in developing agent storage after 50 k printing (g) | Quality of image after 50 k printing (linear flaw of half-tone image) | Quality of image after 50 k printing (blushing under high-temp./high-humid. enviroments) |
| Ex. 1 of prior art | 20.0 | — | Prominent | Prominent |
| Ex. 1 | 5.0 | 25.0 | Slight | Slight |
| Ex. 2 | 7.0 | 15.0 | Slight | Not so prominent |
| Ex. 3 | 4.5 | 30.0 | Not so prominent | Substantially none |
| Ex. 4 | 4.0 | 32.0 | Not so prominent | Substantially none |
| Ex. 5 | 3.0 | 15.0 | Not so prominent | Substantially none |

TABLE 3

| | Test 2 | | |
|---|---|---|---|
| | Color difference (ΔE=) of cyan between image after 50 k printing and initial image | Toner (g) accumulated in developing agent storage after 50 k printing (g) | Quality of image after 50 k printing (linear flaw of half-tone image) |
| Ex. 1 of prior art | 10.0 | — | — |
| Ex. 1 | 2.5 | 30.0 | Slight |
| Ex. 2 | 3.2 | 25.0 | Slight |
| Ex. 3 | 2.2 | 50.0 | Not so prominent |
| Ex. 4 | 2.1 | 70.0 | Not so prominent |
| Ex. 5 | 3.0 | 40.0 | Not so prominent |

The developing agent removing member employed herein was fundamentally effective in removing the normal toner and the toner having the opposite polarity.

In the cleaner-less process, since no cleaner is provided therein, various kinds of foreign matters other than developing agent are permitted to enter into the developing device, thereby raising various problems. For example, if paper dust is permitted to enter into the developing device, the quality of image would be deteriorated. Further, when the printing is resumed after the image forming apparatus has been left to stand under high-temperature/high-humidity environments, the blushing of image would be likely to generate. For example, in the case of the Comparative Example wherein the printing was performed after the image forming apparatus had been left to stand under high-temperature/high-humidity environments, the blushing of image was apparently caused to generate. Whereas in the case of Example 1, it was possible to greatly suppress the generation of blushing, and in the case of Example 2, it was also possible, though not so much effective as in the case of Example 1, to suppress the generation of blushing. Further, in the case of Examples 3 to 5 wherein AC bias was applied to the electrification disturbing means, the generation of blushing was substantially suppressed and effective removal of paper dust was confirmed.

As for the paper dust, it may be formed of calcium carbonate so that the dust is liable to be charged with positive polarity. Further, when the paper dust is formed of talc or kaolin, the dust is liable to be charged with negative polarity. Since it is merely possible to remove only calcium carbonate whose polarity is the same as that of the reversely electrified developing agent when only DC bias is applied thereto, it has been unavoidable to generate some degree of blushing though the application of DC bias is effective. In the case of Examples 3 to 5 wherein AC bias was superimposed, it was assumed that it was possible to remove most of paper dust, thereby substantially preventing the generation of blushing though even the residual developing agent charged with normal polarity was caused to recover slightly.

In the Examples described above, a developing agent manufactured by means of polymerization method was employed. This is advantageous in that the toner to be obtained are excellent in uniformity of particle size distribution and the electrification, that, since the configuration of toner is almost spherical, it is possible to enhance the transferring efficiency and stability, and that, since it is possible to reduce the absolute quantity of reversely transferred toner, the miniaturization of the apparatus can be facilitated. Even a developing agent which has been produced by means of pulverization method is employed, it is also possible to expect sufficient effects though a total level of effects may be lowered to a certain extent.

As described above, according to the present invention, it is possible to selectively remove the reversely electrified developing agent and to prevent color mixing which may become a problem in the cleaner-less process of tandem structure. Further, since it is possible to selectively remove paper dust, it would be possible to retain the production of high-quality image for a long period of time.

In the present invention, since reverse transfer removing means is attached to the electrification disturbing means, it is possible to greatly miniaturize and simplify the image forming apparatus. Further, since the space for storing the developing agent that has been removed is formed into a cartridge by integrally constructing the photoreceptor and the electrification portion, they can be renewed en bloc and hence it is possible to actually unnecessitate the exchange operation of only the waste toner.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color image forming apparatus which comprises two or more stages of image-forming units each image-forming unit comprising:

an electrification portion provided with an electrifying member disposed to face an image carrier and designed to electrostatically charge the image carrier with a uniform surface potential and to remove memories retained in residual developing agent left remained on the image carrier;

an exposure portion which irradiates the image carrier with light in conformity with on the image carrier;

a developing portion which feeds electrified developing agent to the electrostatic latent image to develop the electrostatic latent image on the image carrier to form a developing agent image; and a transferring portion which transfers the developing agent image to a transferring medium to form a transferred image;

wherein the developing portion is provided with a mechanism which forms the developing agent image and recovers residual developing agent left remained on the image carrier; and the electrification portion of at least the image-forming unit or the image-forming units which are disposed at the second stage and thereafter are further provided with a developing agent-removing member which is in contact with the electrifying member to remove from the electrification portion the developing agent which is reversely transferred from the transferred image of a preceding stage and recovered by the electrification portion.

2. The color image forming apparatus according to claim 1, wherein the developing agent-removing member is adapted to be impressed with a bias voltage.

3. The color image forming apparatus according to claim 1, wherein the electrifying member is formed of a fiber brush-like member.

4. The color image forming apparatus according to claim 1, wherein the electrifying member is formed of a roller-like member.

5. The color image forming apparatus according to claim 1, wherein the electrifying member is formed of a magnetic brush electrifier.

6. The color image forming apparatus according to claim 1, wherein the developing agent-removing member is formed of a roller-like member.

7. The color image forming apparatus according to claim 1, wherein the developing agent-removing member is formed of a fiber brush-like member.

8. The color image forming apparatus according to claim 1, wherein the developing agent-removing member is constituted by a roller member and a blade member mounted to contact with the roller member.

9. The color image forming apparatus according to claim 1, wherein the developing agent-removing member 5 is constituted by a roller member and a fiber brush mounted to contact with the roller member.

10. The color image forming apparatus according to claim 1, wherein the developing agent-removing member is formed of a plate-like member.

11. The color image forming apparatus according to claim 1, wherein the developing agent-removing member is designed to remove the developing agent and paper dust.

12. The color image forming apparatus according to claim 1, wherein the electrification portion of at least the image-forming unit or the image-forming units which are disposed at the second stage and thereafter are further provided with a developing agent storage portion which stores the developing agent that has been removed, and the electrifying member, the developing agent-removing member and the developing agent storage portion are constructed integral with each other.

13. The color image forming apparatus according to claim 1, wherein the electrification portion is further provided with a developing agent storage portion which stores the developing agent that has been removed, wherein the capacity of the developing agent storage portion of at least the image-forming unit of the last stage is not smaller than that of any of the developing agent storage portion of the image-forming unit(s) of preceding stages, and at least one of the developing agent storage portions of the image-forming unit(s) of preceding stages is smaller in capacity than the developing agent storage portion of the image-forming unit of the last stage.

14. The color image forming apparatus according to claim 1, wherein the developing agent is manufactured by polymerization.

* * * * *